US007657200B2

(12) United States Patent
Nogami

(10) Patent No.: US 7,657,200 B2
(45) Date of Patent: Feb. 2, 2010

(54) FIXING DEVICE AND IMAGE FORMING APPARATUS USING THE SAME

(75) Inventor: Yutaka Nogami, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 571 days.

(21) Appl. No.: 11/476,884

(22) Filed: Jun. 29, 2006

(65) Prior Publication Data

US 2007/0134031 A1 Jun. 14, 2007

(30) Foreign Application Priority Data

Dec. 13, 2005 (JP) ..... P2005-359371

(51) Int. Cl.
*G03G 15/20* (2006.01)
*G03G 15/00* (2006.01)

(52) U.S. Cl. ..... 399/68; 399/322; 399/329; 399/385

(58) Field of Classification Search ..... 399/68, 399/69, 322, 329, 385
See application file for complete search history.

(56) References Cited

U.S. PATENT DOCUMENTS 6,647,221 B1 * 11/2003 Furuyama ..... 399/69
2004/0183880 A1 * 9/2004 Kito ..... 347/101
2005/0025540 A1 * 2/2005 Murai et al. ..... 399/341

FOREIGN PATENT DOCUMENTS

| | | |
|---|---|---|
| JP | 02-146577 | 6/1990 |
| JP | 2003-241453 A | 8/2003 |
| JP | 2003-345156 | 12/2003 |
| JP | 2004-151200 | 5/2004 |

* cited by examiner

*Primary Examiner*—David M Gray
*Assistant Examiner*—Joseph S Wong
(74) *Attorney, Agent, or Firm*—Morgan, Lewis & Bockis LLP

(57) ABSTRACT

A fixing device for fixing an unfixed toner image by heating and pressurizing a recording material by which the unfixed toner image is carried includes a heating member having a heat source, a pressurizing member that faces the heating member and that forms a fixing nip region between the heating member and the pressuring member, a belt member that circulates while being tensioned around the heating member and is able to transport the recording material while in contact with a surface of the unfixed toner image of the recording material, and a belt driving device that temporarily stops or decelerates the belt member after a rear edge of the recording material passes through the fixing nip region, and that restores the belt member before a leading edge of a subsequent recording material reaches the fixing nip region.

16 Claims, 16 Drawing Sheets

FIG. 9

| DISTANCE OF PAPER REAR EDGE FROM FIXING NIP (mm) | 0 | 5 | 10 | 15 | 20 |
|---|---|---|---|---|---|
| BLISTER | X | X | X | O | O |

FIG. 11

| PAPER TEMPERATURE AT TIME OF DETACHMENT (C°) | 100 | 90 | 80 | 70 | 60 |
|---|---|---|---|---|---|
| GLOSS IRREGULARITIES AT TIME OF DETACHMENT | X | X | O | O | O |

FIG. 14

| DISTANCE OF PAPER REAR EDGE FROM FIXING NIP (mm) | 0 | 5 | 10 | 15 | 20 |
|---|---|---|---|---|---|
| BLISTER | X | X | X | X | O |

FIG. 15

| PAPER TEMPERATURE AT TIME OF DETACHMENT (C°) | 100 | 90 | 80 | 70 | 60 |
|---|---|---|---|---|---|
| GLOSS IRREGULARITIES AT TIME OF DETACHMENT | X | X | O | O | O |

FIXING DEVICE AND IMAGE FORMING APPARATUS USING THE SAME

CROSS-REFERENCE TO RELATED APPLICATION

This application claims priority under 35 USC 119 from Japanese patent document 2005-359371, the disclosure of which is incorporated by reference herein.

BACKGROUND

1. Technical Field

The present invention relates to an image forming apparatus that fixes an unfixed toner image formed on a recording material using electrophotography, electrostatic recording, or the like by heating and fusing, and a fixing device using an endless belt member at the time of fixing and an image forming apparatus using the device.

2. Related Art

Conventionally, in an image forming apparatus such as a copier and printer utilizing electrophotography or the like, as a fixing method for turning an unfixed toner image formed and carried on a recording material into a permanent image by the intermediate transfer method or direct transfer method, a fixing device of type using heat and pressure rolls has been used.

In the type using heat and pressure rolls, a heat roll (fixing roll) and a pressure roll are rotated in pressure contact with respect to each other. The recording material carrying the unfixed toner image is passed through the fixing nip region as the pressure contact part with each other of the pair of rolls. The toner image is heated, pressurized, and fixed on the recording material.

Recently, a method of outputting a digital image in the same finishing as that of a photo print in an image forming apparatus has been proposed.

On the other hand, in character output, a less glossy (low-gloss) image is preferable for better viewing of characters by human eyes. Accordingly, when not only photo printing but also conventional outputting of characters principally is performed, a technology of selectively using two fixing devices, one for fixing as a low-gloss image and another for fixing as a high-gloss image according to need, has been proposed.

As the fixing device for outputting a high-gloss print, an unfixed toner image on a recording material is brought into contact with a fixing belt surface in contact with the fixing roll side and is heated, pressurized, and fused. The fused toner image is cooled to predetermined temperature while the fixing belt is in contact with the recording material, and then, the recording material is detached from the fixing belt. Thereby, the toner image surface can be transferred to the smooth surface property of the fixing belt surface, and consequently, a high-gloss image is obtained.

SUMMARY

According to an aspect of the invention, there is provided a fixing device for fixing an unfixed toner image by heating and pressurizing a recording material by which the unfixed toner image is carried, the fixing device including: a heating member having a heat source; a pressurizing member that faces the heating member and that forms a fixing nip region between the heating member and the pressuring member; a belt member that circulates while being tensioned around the heating member and is able to transport the recording material while in contact with a surface of the unfixed toner image of the recording material; and a belt driving device that temporarily stops or decelerates the belt member after a rear edge of the recording material passes through the fixing nip region, and that restores the belt member before a leading edge of a subsequent recording material reaches the fixing nip region.

BRIEF DESCRIPTION OF THE DRAWINGS

Exemplary embodiments of the present invention will be described in detail based on the following figures, wherein:

FIG. 9 is a table showing the blister evaluation result of example 1;

FIG. 11 is a table showing the gloss irregularity evaluation result of example 1;

FIG. 14 is a table showing the blister evaluation result of example 2;

FIG. 15 is a table showing the gloss irregularity evaluation result of example 2;

DETAILED DESCRIPTION

Hereinafter, the invention will be described in detail based on exemplary embodiments shown in the accompanying drawings.

Figure 1:
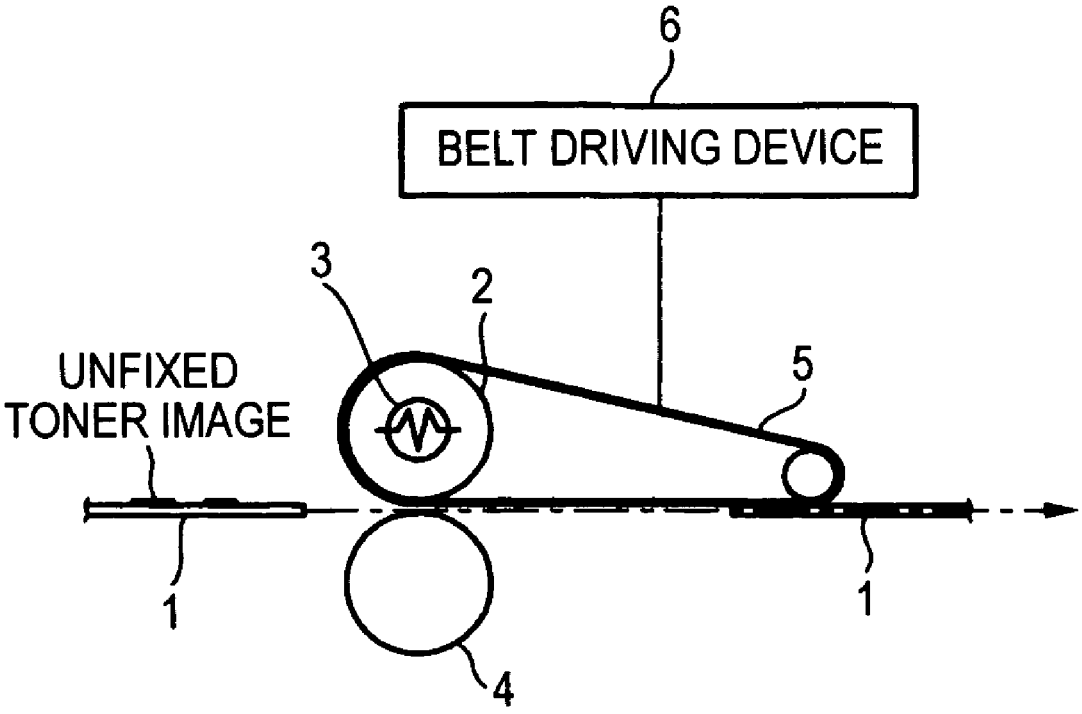
FIG. 1 is an explanatory diagram showing the outline of the fixing device according to an aspect of the invention.

At the beginning, a fixing device according to an aspect of the present invention is described with reference to FIG. 1. As shown in FIG. 1, a fixing device 1 is for fixing an unfixed toner image by heating and pressurizing a recording material 1 by which the unfixed toner image is carried. The fixing device 1 includes a heating member 2 having a heat source 3, a pressurizing member 4 oppositely provided to the heating member 2 and forming a fixing nip region between the heating member 2 and itself, a belt member 5 provided so as to circulate while being tensioned around the heating member 2 and able to transport the recording material 1 in contact with the toner image surface of the recording material 1, and a belt driving device 6 that temporarily stops or decelerates the belt member 5 after a rear edge of the recording material 1 passes through the fixing nip region and restores the belt member 5 before a leading edge of a subsequent recording material 1 reaches the fixing nip region.

First Exemplary Embodiment

Figure 2:
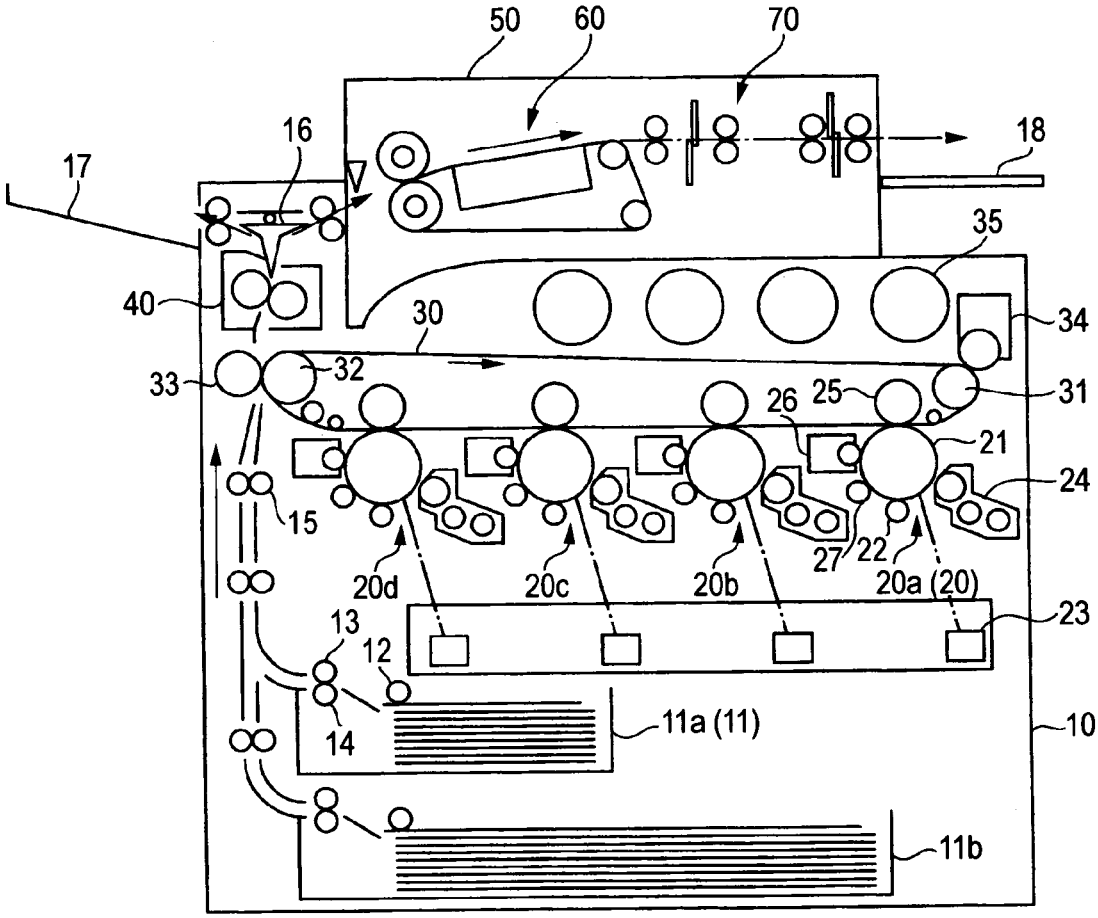
FIG. 2 is an explanatory diagram showing the outline of a first exemplary embodiment of the image forming apparatus according to an aspect of the invention.

FIG. 2 shows a first exemplary embodiment of a color image forming apparatus. In the same drawing, the image forming apparatus of the exemplary embodiment includes an apparatus main body 10 having an image forming unit that can form color images, and additionally mounts a post-processing device 50 as an optional device on top of the apparatus main body 10. On the other hand, multiple paper feed cassettes 11 (11*a*, 11*b*) for feeding paper as recording materials are accommodated below the image forming unit of the apparatus main body 10 in a way that they can be pulled out.

The image forming unit used in the exemplary embodiment adopts electrophotography, for example, and has image creating units 20 (20*a* to 20*d*) of four colors of yellow (Y-color), magenta (M-color), cyan (C-color), and black (B-color) arranged in parallel to an intermediate transfer belt 30, a so-called tandem configuration. Accordingly, the respective toner images formed in the respective image creating units 20 (20*a* to 20*d*) are sequentially transferred onto the intermediate transfer belt 30 for multiplexing, and the multiplexed toner images are transferred by one operation and fixed onto paper transported from the paper feed cassette 11. Note that the color arrangement of the four-color image creating units 20 are not limited to the above order and other orders may be adopted.

The image creating unit 20 (20*a* to 20*d*) in the exemplary embodiment has a photoconductor 21 that forms and carries each color component toner, a charger 22 that charges the photoconductor 21 such as a charging roll, an exposure unit 23 that forms a latent image on the charged photoconductor 21 such as a laser scanner, a developing unit 24 for visualizing the electrostatic latent image on the photoconductor 21, a first transfer unit 25 of a first transfer roll, for example, that transfers the toner image on the photoconductor 21 onto the intermediate transfer belt, a photoconductor cleaner 26 that cleans the residual toner left on the photoconductor 21, a static eliminator 27 that eliminates the residual charge on the photoconductor 21, etc. Note that the exposure unit 23 in the exemplary embodiment performs exposure of the entire image creating unit 20 (20*a* to 20*d*) by one exposure unit.

Further, the intermediate transfer belt 30 is tensioned around plural tension rolls, and for example, circulated and transported using a tension roll 31 as a drive roll. For example, a second transfer unit 33 of second transfer roll, is oppositely provided using a tension roll 32 as a backup roll. Further, in the position opposed to the tension roll 31 of the intermediate transfer belt 30, a belt cleaner 34 is provided that removes the residual toner on the intermediate transfer belt 30.

Furthermore, within the apparatus main body 10 above the intermediate transfer belt 30, toner boxes 35 of four colors that supply toner to corresponding developing units 24 of the respective image creating units 20 are provided, and supply the toner to the developing units 24 corresponding to the respective colors via transport paths (not shown).

Moreover, the paper transport system in the exemplary embodiment operates in the following manner. The paper fed from each paper feed cassette 11 by a pickup roll 12 is separated by the operation of a feed roll 13 and a retard roll 14, so that only one sheet of paper may be transported into the transport path at the downstream side. Further, in the transport path, a resist roll 15 that positions the paper transported from the paper feed cassette 11 before the paper enters the second transfer unit 33 is processed. A first fixing unit 40 that fixes the unfixed toner image transferred onto the paper by the second transfer unit 33 is also provided. Furthermore, a switching member 16 is provided at the downstream side of the first fixing unit 40. The paper exiting from the first fixing unit 40 may be switched between two paths toward either the post-processing device 50 side or the first eject tray 17 side which accommodates the paper directly ejected from the apparatus main body 10, by switching the switching member 16.

Although the paper feed cassettes 11 have been shown as the two paper feed cassettes 11*a*, 11*b* for accommodating paper in different sizes, three or more may be provided, or one may be provided. Further, a manual paper feed tray (not shown) may be provided for guiding the paper from the manual paper feed tray to the transport path.

Figure 3:
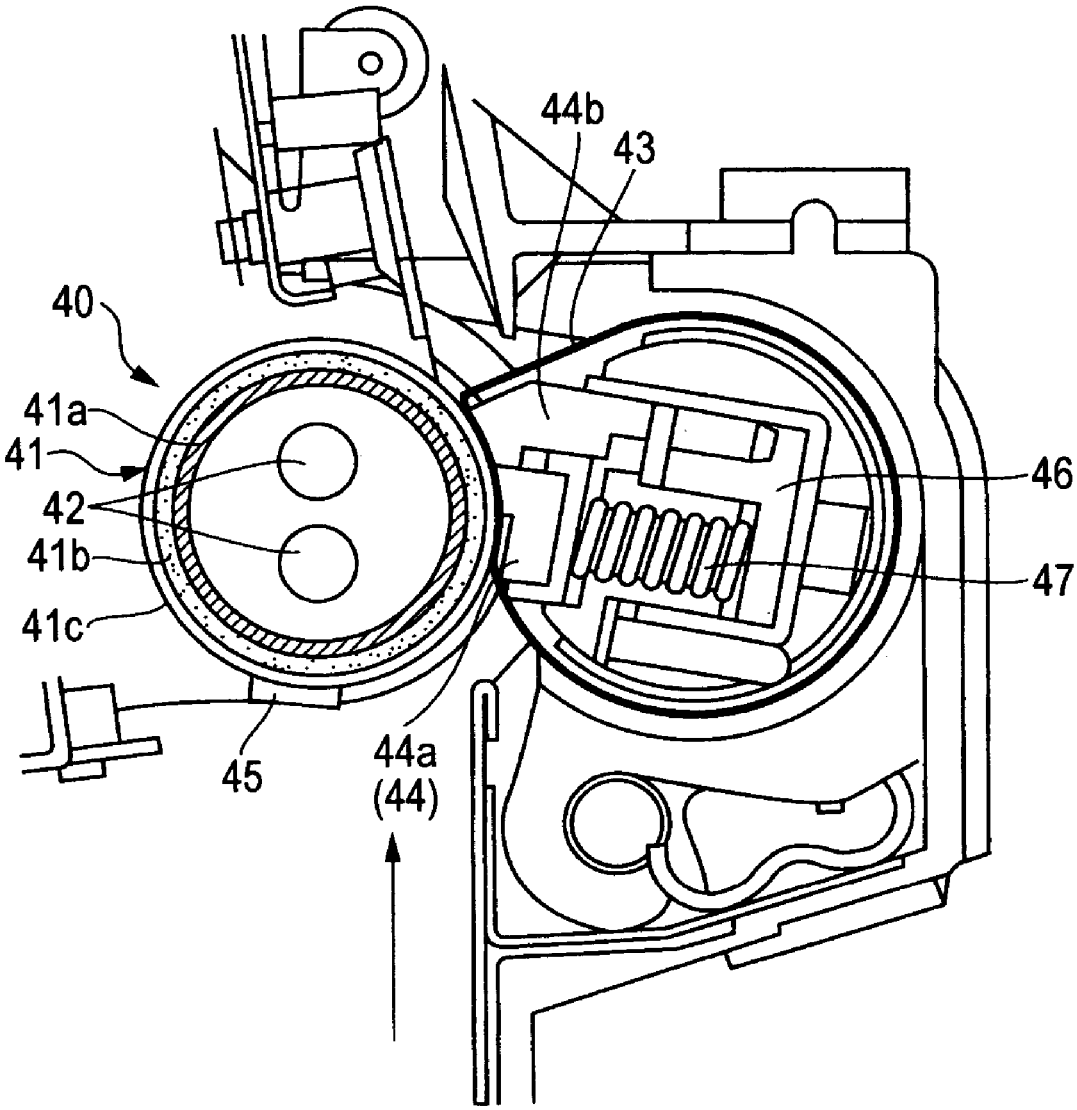
FIG. 3 is an explanatory diagram showing the outline of the first fixing unit of the first exemplary embodiment.

The first fixing unit 40 of the exemplary embodiment has a configuration shown in FIG. 3. In the same drawing, the first fixing unit 40 is configured in a so-called free belt nip system including a fixing roll 41 having a heat source 42 such as a halogen lamp within, a pressure belt 43 rolling with the fixing roll 41 to sandwich and transport the paper, and pressure pads 44 (44*a*, 44*b*) that are provided on the rear surface side of the pressure belt 43 and form a fixing nip region between the fixing roll 41 and the pressure belt 43. In the drawing, the sign 46 denotes a support member that fixes and supports the pressure pad 44*b* at the downstream side. The sign 47 denotes a spring that is provided between the support member 46 and the pressure part 44*a* at the upstream side, and urges the pressure part 44*a* toward the fixing roll 41 side.

The fixing roll 41 is formed by coating the surface of a cylindrical core 41*a* made of metal having advantageous mechanical strength and good heat conduction such as aluminum, with an elastic layer 41*b* of silicone rubber or the like, and coating the surface of the elastic layer 41*b* with a release layer 41*c* of PFA (tetrafluoroethylene-perfluoroalkoxyethylene copolymer) tube.

Further, a heat source 42 such as a halogen lamp or the like is provided inside of the fixing roll 41 for controlling the surface temperature of the fixing roll 41 to be a predetermined temperature.

Here, the material of the core 41*a* is not especially limited as long as it has mechanical strength and good heat conduction. For example, metal such as stainless, steel, and brass, or an alloy thereof may be used.

Further, the elastic layer 41*b* is not limited to silicone rubber, but fluorine type rubber or the like may be used as long as it has heat resistance. The method for forming the elastic layer 41*b* on the surface of the core 41*a* is not especially limited, and injection molding, coating, or the like may be adopted.

Furthermore, as long as the release layer 41*c* has heat resistance and adequate releasability to toner, fluorine series rubber, fluorine series resin or the like may be used.

Moreover, the shape and structure of the heat source 42 in the fixing roll 41 are not limited as long as they can be accommodated within the core 41*a*, and the heat source may be appropriately selected according to the purpose.

Further, in the exemplary embodiment, a temperature sensor 45 for sensing the surface temperature of the fixing roll 41 is provided around the fixing roll 41. The temperature control of the heat source 42 is performed by the temperature sensor 45 so that the surface temperature of the fixing roll 41 will be a predetermined temperature. The temperature sensor 45 is not especially limited as long as it can measure the surface temperature of the fixing roll 41, and for example, a heat-sensitive element such as a thermistor or posistor may be used.

On the other hand, a polyimide film of about 75 μm in thickness is used as a base material of the pressure belt 43, and a release layer of PFA is laminated on the surface thereof. The base material of the pressure belt 43 is not limited to polyimide, but a resin base material such as polyamide-imide or a metal base material such as stainless, nickel, and copper, for example, may be used as long as it has heat resistance. Further, the release layer is not limited to PFA as long as it has detachability of toner attached to the surface. As the material thereof, for example, a fluorine type resin such as PTFE (tetrafluoroethylene) and FEP (tetrafluoroethylene-hexafluoropropylene copolymer), fluoro-rubber, silicone rubber, or the like may be used.

As shown in FIG. 2, the post-processing device 50 of the exemplary embodiment includes a second fixing unit 60 that makes the toner image surface of the paper highly glossy, and a sheet cutting device 70 that cuts the paper that has passed through the second fixing unit 60.

Figure 4:
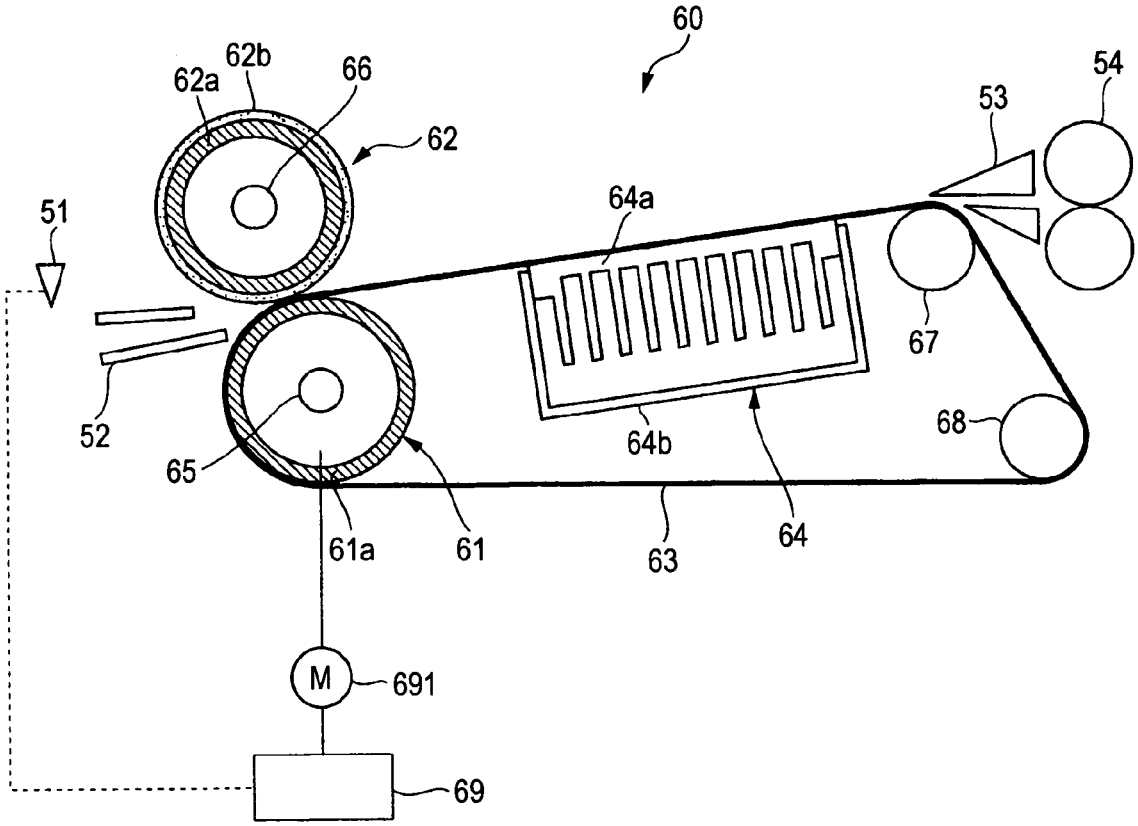
FIG. 4 is an explanatory diagram showing the outline of the second fixing unit of the first exemplary embodiment.

As shown in FIG. 4, the second fixing unit 60 includes a fixing roll 61, a pressure roll 62 oppositely provided to the fixing roll 61, a fixing belt (belt-like fixing member) 63 that is sandwiched and transported between the fixing roll 61 and the pressure roll 62 and tensioned around the fixing roll 61 and circulated, and a cooler 64 that is provided in contact with the rear surface of the fixing belt 63 at the downstream side of the fixing roll 61 and cools the fixing belt 63.

The fixing roll 61 has a configuration in which a release layer (not shown) of PFA tube or the like is formed around a metal core 61*a* with high heat conduction. A heat source 65 of halogen lamp or the like is provided within the core 61*a*. The surface of the fixing roll 61 is heating-controlled by the heat source 65 to a predetermined temperature. Further, in the exemplary embodiment, the fixing belt 63 circulates by the rotation of the fixing roll 61.

On the other hand, in the pressure roll 62, the periphery of a metal core 62*a* with high heat conduction is coated with an elastic layer 62*b* of silicone rubber or the like. A release layer (not shown) that is the same as the release layer of the fixing roll 61 is formed on the surface of the elastic layer 62*b*. Further, in the exemplary embodiment, a heat source 66 of halogen lamp or the like is also provided within the core 62*a* of the pressure roll 62, and the surface of the pressure roll 62 is heating-controlled to a predetermined temperature. Accordingly, the paper that has been transported to the second fixing unit 60 is heated and pressurized in a fixing nip between the fixing roll 61 and the pressure roll 62 while the toner image surface is in contact with the fixing belt 63.

Furthermore, in the fixing belt 63, a highly smooth covering layer of fluoro-rubber, silicone rubber, or the like is formed on the surface of an endless film made of thermosetting polyimide resin, for example. The belt is tensioned around the fixing roll 61, a detaching roll 67, and a steering roll 68 so as to be circulated by the rotation of the fixing roller 61. The detaching roll 67 follows the movement of the fixing belt 63 and rotates. When the detaching roll 67 tensions the fixing belt 63 around itself, the movement direction of the fixing belt 63 is drastically changed. The paper on the fixing belt 63 is naturally detached from the fixing belt 63 because of the rigidity of the paper itself at the location of the detaching roll 67. Further, the steering roll 68 is to constantly tension the fixing belt 63 itself, and is provided for maintaining the tension by pressing the fixing belt 63 outwards and correcting the bias (the phenomenon that the fixing belt 63 moves toward one of the ends of the steering roll 68) that occurs when the fixing belt 63 circulates.

As the base material and covering layer of the fixing belt 63, the covering layer of about 35 μm is formed on the base material of about 75 μm in order to maintain the mechanical strength and effectively utilize the heat energy.

Furthermore, the cooler 64 within the second fixing unit 60 in the exemplary embodiment is provided between the fixing roll 61 and the detaching roll 67. The cooler is in contact with the fixing belt 63 rear surface, and cools the fixing belt 63 by absorbing heat of the fixing belt 63. Accordingly, the paper transported in close contact with the fixing belt 63 is cooled. The cooler 64 in the exemplary embodiment has a cylindrical shape including a fin member 64*a* with many heat release fins extending nearly perpendicularly from the surface along the fixing belt 63, and a cover 64*b* provided so as to cover the fin member. The heat of the fin member 64*a* is forcibly released by flowing air inside using a blower (not shown) In the drawing, the sign 51 denotes a sensor that senses the passing timing of the paper, and the signs 52, 53 denote paper guides provided in the paper transport path of the second fixing unit 60, and the sign 54 denotes a transport roll.

In the exemplary embodiment, a drive motor 691 that drives the fixing roll 61 is controlled by a control device 69 to turn ON/OFF the rotation of the fixing roll 61. Further, the control device 69 sequence-controls the rotation of the fixing roll 61 according to the passing timing of the paper obtained from the sensor 51. In the exemplary embodiment, the fixing roll 61 stops at the position where the rear edge of the paper exits the fixing nip and then advances by a predetermined distance. The paper stops while attached to the fixing belt 63. The control device 69 turns back the rotation of the fixing roll 61 before the subsequent paper reaches the second fixing unit 60.

Figure 5A:
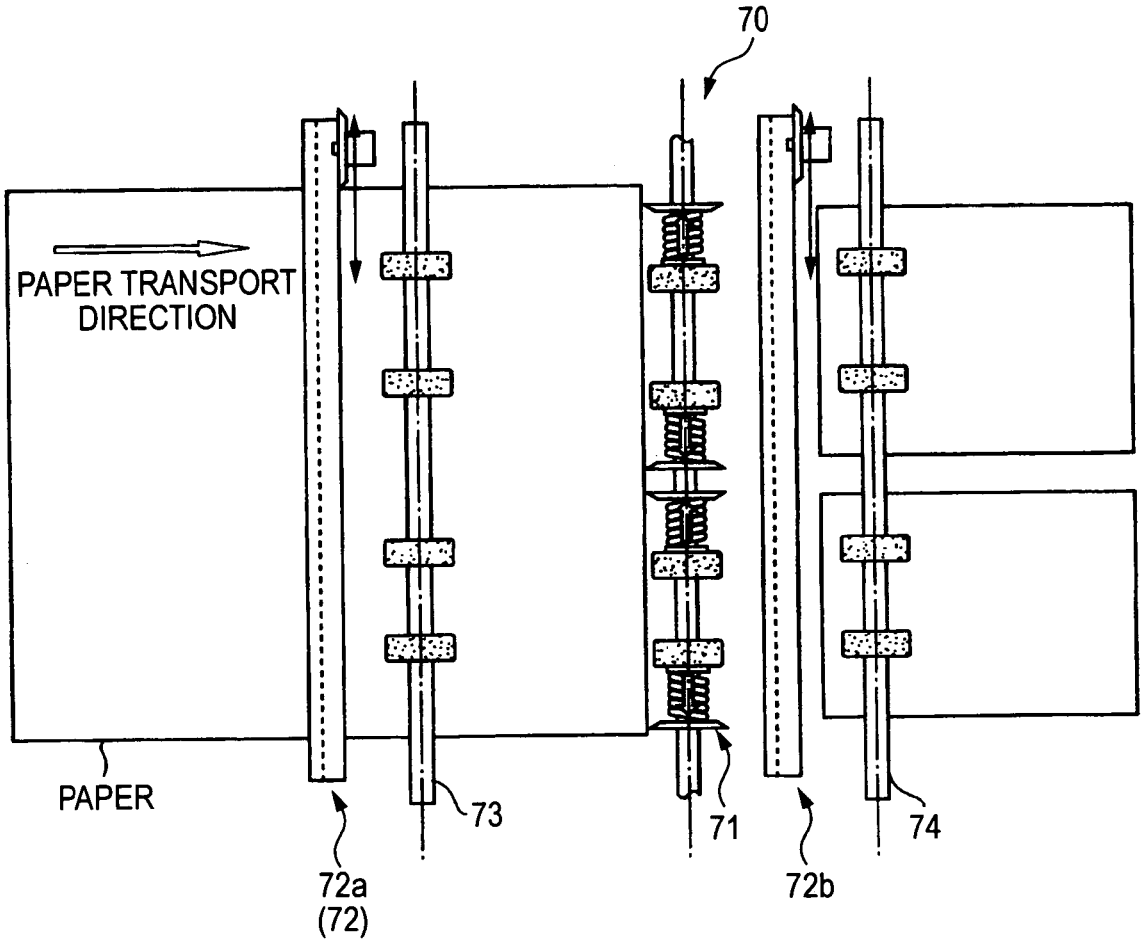
FIG. 5A and 5B is an explanatory diagram showing the outline of the sheet cutting device of the first exemplary embodiment.

Further, the sheet cutting device 70 shown in FIG. 5A enables cutting of four sides of the paper, and can fabricate borderless prints, for example. Accordingly, the device includes a slitter 71 for cutting in the widthwise direction of paper, plural circular cutters 72 (72*a*, 72*b*) for cutting in the lengthwise feeding direction of paper, and plural transport rolls 73, 74 for transporting paper. The slitter 71 has blades in the number according to the number of required cuttings in the axis direction, so that it cuts the paper in the feeding direction while transporting the paper. Further, the circular cutters 72 cut the paper by temporarily stopping the transport of paper and moving an upper blade of a rolling cutter along a lower blade.

Figure 5B:
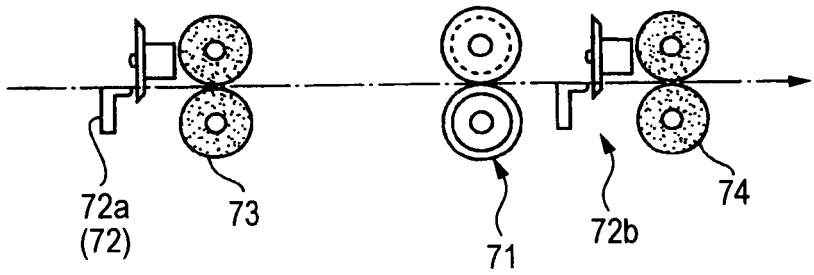

On the other hand, FIG. 5B shows the device of (a) seen from the cross section thereof.

Here, as the circular cutter 72, for example, a roller cutter may be provided along the axial direction for cutting the paper while transporting it.

In the exemplary embodiment as shown in FIG. 2, a second eject tray 18 is provided at the downstream side of the post-processing device 50 for accommodating paper that has passed through the sheet cutting device 70.

Further, not only can the sheet cutting device 70 cut the paper into four pieces as shown in the drawing, but it is also capable of turning one sheet of L-size image printed in a postcard-size (100×150 mm) sheet, for example, into a borderless print. Furthermore, by combining the printing of four images on an A4-size sheet and the printing of images one by one in an arbitrary number of postcard-size sheets, an arbitrary number of L-size digital photos can be obtained. Moreover, by varying the width direction position of the blade of the slitter 71, the sheet can be cut into various sizes such as a quarter, a sixth, or an eighth.

Next, an operation in the image forming apparatus will be described.

As shown in FIG. 2, the respective color toner images by the respective image creating units 20 (20*a* to 20*d*) are multiplexed on the paper fed out from the paper feed cassette 11. The multiple toner images formed on the intermediate transfer belt 30 are transferred by one operation of the second transfer unit 33. The transferred unfixed etoner image is fixed by the first fixing unit 40, and then guided to the first eject tray 17 or second eject tray 18 by the switching member 16.

In the exemplary embodiment, switching between paper transport directions by the switching member 16 is performed in the following manner. That is, in the plain paper printing mode of forming normal images (low-gloss printing), after fixing in the first fixing unit 40, the paper is ejected to the first eject tray 17 by the switching member 16. On the other hand, in the photo printing mode of forming high-gloss images like photographic images (high-gloss printing), after fixing in the first fixing unit 40, the paper is ejected to the second fixing unit 60 side by the switching member 16 and fixing by the second fixing unit 60 is further performed. Then, the paper is ejected to the second eject tray 18 via the sheet cutting device 70. Specifically, the sheet cutting device 70 may be used when a borderless print like a photographic image is preferable, and the paper may be ejected to the second eject tray 18 without cutting when there is no need for cutting.

Figure 6A:
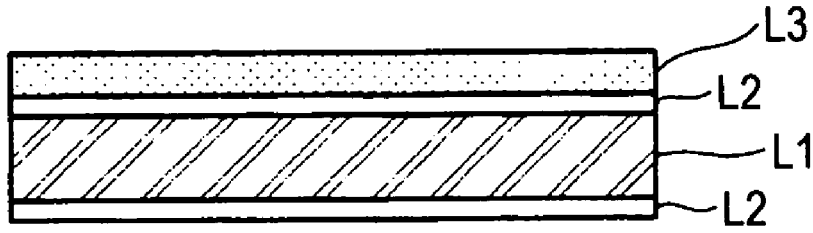
FIGS. 6A, 6B, and 6C are explanatory diagrams showing specialized paper for photographic images, a state in which a toner image is fixed to the specialized paper, and a state in which a toner image is fixed to plain paper.

Normally, to obtain a high-gloss image as a photographic image, specialized paper as shown in FIG. 6A is preferably used. As shown in the same drawing, in the specialized paper, moisture-proof layers L2 are provided on both sides of base material layer L1 and an image receiving layer L3 is further provided on the recording surface (toner image formation surface) side.

The moisture-proof layer L2 is formed by a resin with no air permeability such as polyethylene, and the thickness on the order of several micrometers makes the base material layer L1 moisture-proof. Further, the image receiving layer L3 consists primarily of a thermoplastic resin such as polyester with a melting temperature at about 130° C., for example, and formed with a thickness of 5 to 20 μm. On the other hand, although the base material layer L1 has a composition consisting primarily of cellulose, which is the same composition as plain paper, exclusive base material layer L1 having a different composition can be used.

Therefore, like photographic paper used for silver halide photography, air permeability can be removed by providing the moisture-proof layers L2 on both sides of base material layer L1, and further providing the image receiving layer L3 similar to the toner material. Defects that the base material layer L1 absorbs moisture and expands under the high humidity environment, and curls thereby occur or the toner image is extended and cracked, etc. can be prevented. Smooth print surfaces can be obtained since the toner image is fused together with the receiving layer L3 by the receiving layer L3, and the toner image is embedded in the receiving layer L3 by applying pressure,.

Figure 6B:
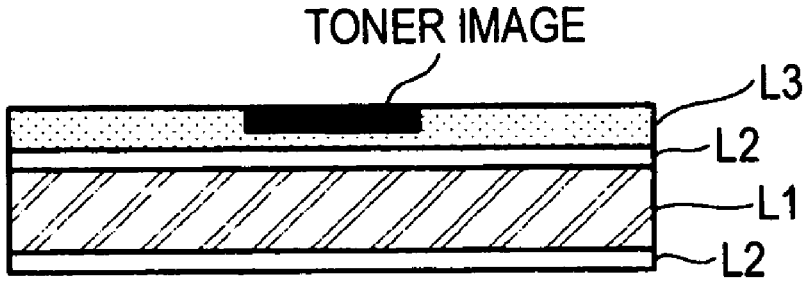
Figure 6C:
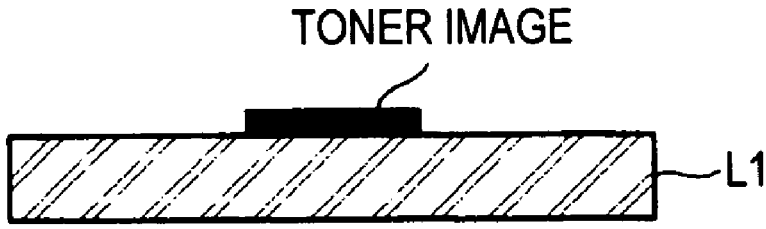

When fixing is performed using the specialized paper by the second fixing unit 60 at the time of photo print mode, the toner image is embedded in the receiving layer L3 as in FIG. 6B. Simultaneously, the surface property of the fixing belt 63 of the second fixing unit 60 is copied and the receiving layer L3 surface and the toner image surface become nearly even, and a glossy image is obtained. On the other hand, FIG. 6C shows a state in which the toner image has been fixed onto plain paper only by the first fixing unit 40 at the time of plain paper print mode. In this case, the toner image is mounted on the base material layer L1, and only the image poor in gloss is obtained because the toner image projects on the image surface.

In the exemplary embodiment, since the paper is stopped at the position where the paper exits the fixing nip between the fixing roll 61 and the pressure roll 62 and then advanced by a predetermined distance, the paper temperature stops at a relatively high temperature. At this time, although the cooling action on the paper by the cooler 64 is interrupted and the cooling action itself becomes insufficient, there is no problem as long as the position is where no image defect occurs.

Figure 7:
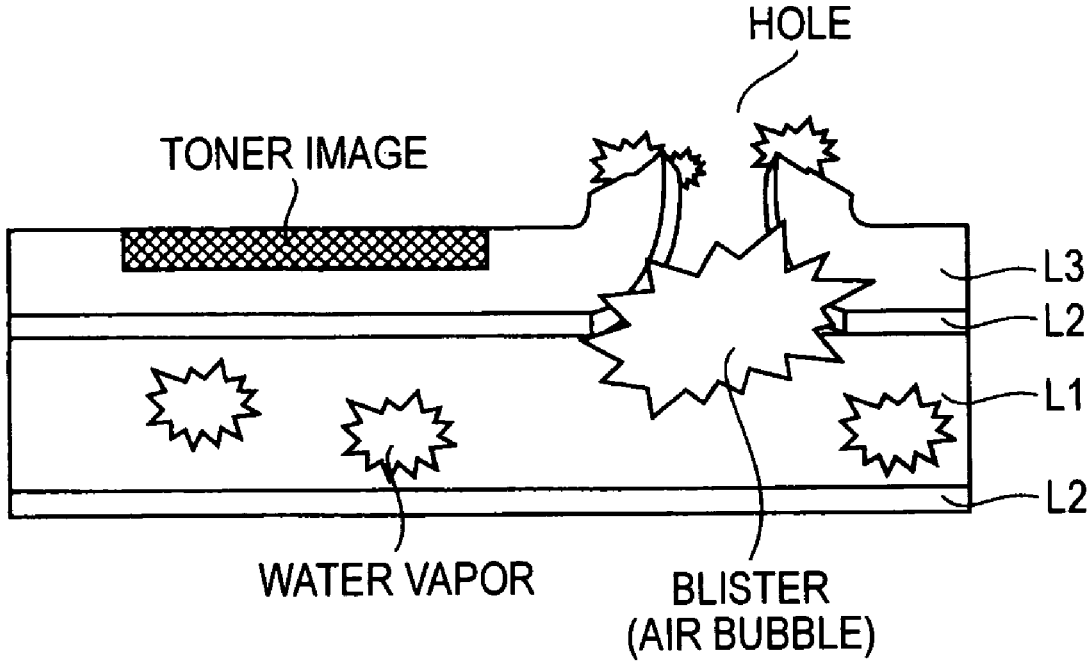
FIG. 7 is an explanatory diagram showing a blister.

Generally, when coated paper having coated layers on both sides like double-sided coated paper or the like is used, the water contained in the base material layer L1 becomes water vapor and expands during heating, and the expanded air bubbles (blisters) cause holes to form in the paper surface. FIG. 7 graphically shows the condition in which bores are produced in the paper surface, and illustrates that water vapor in the base material layer L1 becomes blisters. The moisture-proof layer L2 and the image receiving layer L3 are thereby lifted and holes are produced.

Therefore, in the exemplary embodiment, it is necessary that the position is set to the shortest stop position where the temperature of the rear edge of the paper becomes 100° C. or less so as to avoid occurrence of blisters. Note that the blisters notably occur even when the heating time is about one second if the temperature is more than 100° C. (one atmospheric pressure environment).

Further, the position where the rear edge of the paper is stopped relates to the viscosity of toner and the viscosity of the image receiving layer L3 of paper. It is provided in a position where the toner viscosity is equal to or more than $10^5$ Pa·s and the viscosity of the image receiving layer L3 is equal to or more than $10^5$ Pa·s. When the toner viscosity and the viscosity of the image receiving layer L3 are less than this, the image attached to the fixing belt 63 is insufficiently solidified and rubbed against the fixing belt 63 during subsequent detachment of paper, and uniform gloss is damaged or image distortion is caused.

As described above, in the exemplary embodiment, since paper is once stopped at predetermined distance from the fixing nip during passing through the second fixing unit 60, the temperature reduction of the fixing belt 63 performed by the cooler 64 is interrupted. The reduction speed in the surface temperature of the fixing roll 61 and the pressure roll 62 can be slowed down and the power applied to the heat sources 65, 66 can thus be reduced. Further, since no image defect occurs in the image at this time, the high-quality and low-power-consumption image forming apparatus is possible.

Although the stop position of paper is performed by the sensor 51 at the upstream side of the fixing nip in the exemplary embodiment, for example, the fixing belt 63 may be stopped by providing a sensor at the downstream side of the fixing nip for directly sensing the rear edge of the paper after passing through the fixing nip.

Further, the timing of stopping the paper may be linked with the power to the heat sources 65, 66 of the fixing roll 61 and the pressure roll 62 being reduced or shut down. Further, for example, air blasting to the cooler 64 may be stopped. The power reduction to the heat sources 65, 66 is performed in a range in which the fixing operation of the subsequent paper is not hindered.

Furthermore, although the post-processing device 50 is used as an optional device in the exemplary embodiment, it may be provided integrally in the apparatus main body, or only the second fixing unit 60 may be provided as the post-processing device 50. It is possible that the first fixing unit 40 is deleted, but, in this case, when the paper is transported to the second fixing unit 60, it is necessary to make sure that image distortion not occur from scraping of the unfixed toner image.

Further, although the fixing belt 63 is stopped at the predetermined distance after the paper exits the fixing nip in the exemplary embodiment, for example, the high-quality and low-power-consumption image forming apparatus can be realized not by stopping the fixing belt 63 but decelerating it instead.

Furthermore, when the rear edge of the paper is cut off by the sheet cutting device 70, because the final image is not hindered even if blisters occur in the cut off part, the stop position of the paper may be brought closer to the fixing nip side by a distance corresponding to the cut off part.

A Second Exemplary Embodiment

Figure 8:
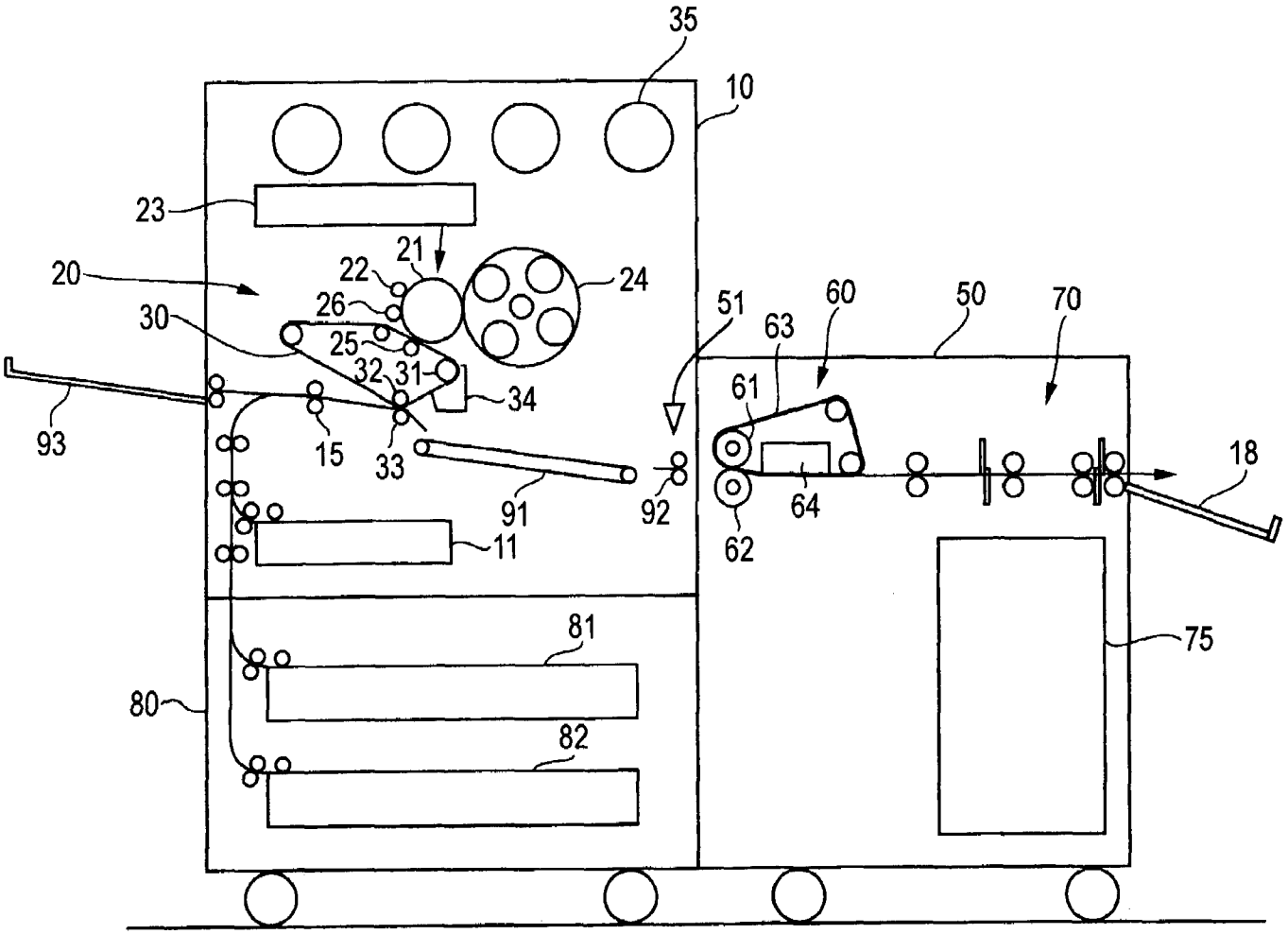
FIG. 8 is an explanatory diagram showing the outline of a second exemplary embodiment of the image forming apparatus according to the invention.

FIG. 8 shows the outline of a second exemplary embodiment of the image forming apparatus. The image forming apparatus of the exemplary embodiment is a so-called cyclic color image forming apparatus by which each color toner image is transferred with respect to each one turn of the intermediate transfer belt 30 and then multiplexed, and then transferred onto paper by one operation on paper unlike the first exemplary embodiment. The same signs are assigned to the same component elements and the detailed description thereof is omitted herein.

The image forming apparatus in the exemplary embodiment is detachably provided with the post-processing device 50 as an optional device at the side of the apparatus main body 10. Further, no fixing unit is provided within the apparatus main body 10, and fixing is performed by the fixing unit (the second fixing unit) 60 of the post-processing device 50.

The image creating unit 20 provided within the apparatus main body 10 includes the photoconductor 21 and the charger 22, the exposure unit 23, the developing unit 24, the first transfer unit 25, the photoconductor cleaner 26, the intermediate transfer belt 30, etc. provided around the photoconductor 21.

Especially, in the exemplary embodiment, the developing unit 24 is a rotary developing unit, and development is performed on each color latent image formed on the photoconductor 21 with each toner, and the development color is switched with respect to each rotation of the photoconductor 21. Then, the toner is replenished from each color toner box 35 to each corresponding position within the developing unit 24.

Further, in the exemplary embodiment, only one paper feed cassette 11 is provided below the image creating unit 20 of the apparatus main body 10, and a paper feed unit 80 is mounted in the lower part of the apparatus main body 10 and two paper feed cassettes 81, 82 are provided within the unit.

Furthermore, in the apparatus main body 10, the paper onto which unfixed toner images have been transferred by one operation by the second transfer unit 33 is transported by a transport belt 91, and transported to the post-processing device 50 side via an eject roll 92. On the side of the apparatus main body 10 at the upstream side of the resist roll 15, a manual paper feed tray 93 for manually feeding paper is provided.

Moreover, in the exemplary embodiment, the sensor 51 that senses the passing timing of the paper in the fixing unit 60 is provided at the apparatus main body 10 side.

Further, the fixing unit 60 within the post-processing device 50 has the same configuration as that of the second fixing unit 60 of the first exemplary embodiment (see FIG. 4), and is provided upside down in the exemplary embodiment relative to the unit of the first exemplary embodiment because the toner image surface directs upward. Since the configuration and operation in the fixing unit 60 are the same as those in the first exemplary embodiment, they are omitted herein. Furthermore, since the sheet cutting device 70 is the same as that in the first exemplary embodiment (see FIG. 5), the description of the configuration and operation thereof are omitted. The sign 75 denotes a collection box that collects pieces cut off by the sheet cutting device 70.

EXAMPLE 1

The example is that, when a high-gloss print is formed on paper of L-size (89×127 mm) with margins and then four sides thereof are cut and a borderless print is output by the image forming apparatus of the first exemplary embodiment, an evaluation test is performed at the time of detachment on occurrence of blisters of paper on the fixing belt and image defects.

The test conditions are as follows.

(1) Condition of Fixing Unit Settings

- Fixing roll . . . width: 140 mm (effective width), outer diameter: 50 mm, elastic layer: none, surface preset temperature: 150° C.
- Pressure roll . . . width: 140 mm (effective width), outer diameter: 50 mm, elastic layer: silicone rubber of 2 mm in thickness and 60 degrees in hardness, surface preset temperature: 130° C.
- Fixing belt . . . width: 130 mm, perimeter: 550 mm, material: silicone rubber (50 degrees in hardness) of 40 μm is laminated on a thermosetting polyimide base material of 100 μm
- Fixing load . . . 1200 N
- Fixing belt drive speed at the time of fixing . . . 60 mm/s
- Cooler . . . heat sink length: 80 mm (in the transport direction)

(2) Paper

- Size . . . 100×150 mm (L-size paper is formed by cutting four sides of postcard-size paper)
- Thickness . . . 220 μm (basis weight: 225 gsm)
- Surface finishing . . . polyester resin of 10 μm (viscosity is $10^4$ Pa·s at melt temperature of about 110° C.)

(3) Other conditions

- Paper transport direction . . . portrait orientation
- Printing speed . . . eight sheets per minute
- Toner . . . toner consisting of styrene-acrylic resin having melting temperature of about 100° C. (viscosity is $10^4$ Pa·s)

The blister evaluation is performed by observing what the distance at which the rear edge of paper departs from the fixing nip is good. As shown in FIG. 9, the result is that the occurrence of blisters is not recognized when the edge departs from the fixing nip by 15 mm. Further, blisters occur for 10 mm. Therefore, from the example, it is confirmed that the fixing belt may be stopped or decelerated in a position where the rear edge of paper departs from the fixing nip by 15 mm.

Figure 10:
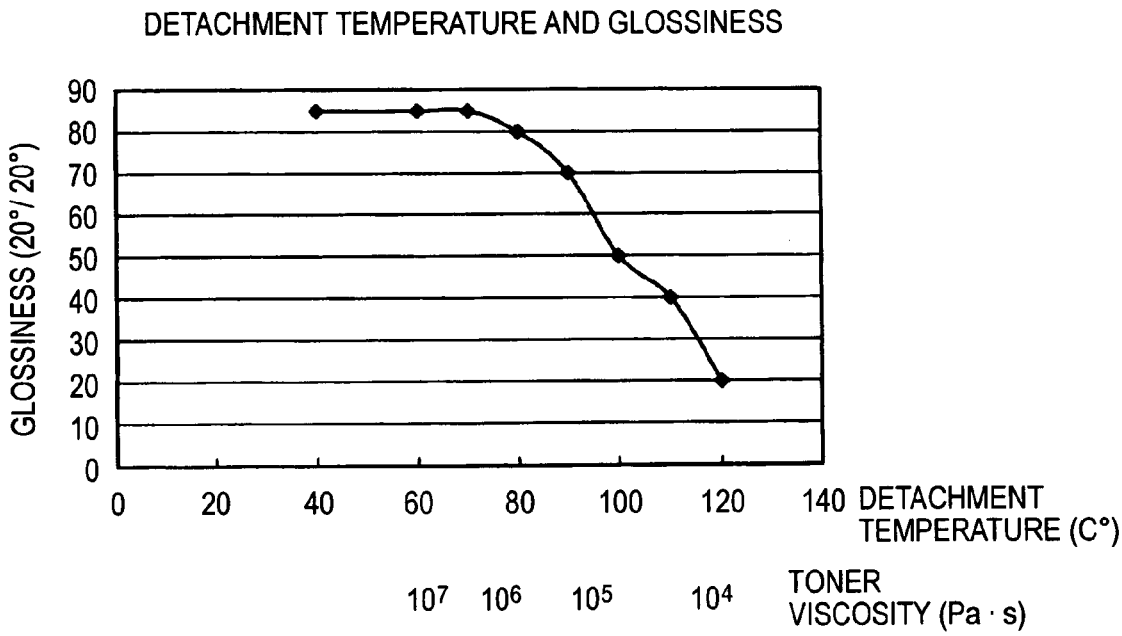
FIG. 10 is a graph showing the relationship between temperature and glossiness of example 1.

On the other hand, regarding image defects, the relationship between temperature and glossiness at the time of detachment from the fixing belt is checked by changing air blasting conditions to the cooler, and the result as in FIG. 10 is obtained. From the result, it is found that the obtained glossiness is constant when the detachment temperature is equal to or less than 70° C. Further, although the glossiness becomes about five degrees lower than that in the case of 70° C. or less when the detachment temperature is 80° C., there appears to be no problem because about five-degree difference in glossiness does not appear as a visual difference (it is hard to be recognize).

Further, focusing attention on toner viscosity, when it exceeds $10^5$ Pa·s, it is found that the gloss never changes depending on the detachment speed or temperature at the time of detachment, and uniform and good-quality gloss can be obtained.

Furthermore, when the gloss irregularities are visually recognized in images when the detachment temperature is changed, the result as in FIG. 11 is obtained. From the result, it is found that no gloss irregularities are recognized when the detachment temperature is equal to or less than 80° C.

The measurement of glossiness is performed using gloss measurement equipment (manufactured by BYK-Gardner) with high sensitivity in specular gloss, incident angle of 20°, and reflection angle of 20°.

Next, a comparison test with respect to average power consumption in the fixing unit when the drive control method of the fixing belt is changed is performed in the above described conditions.

The three kinds of drive conditions of the fixing unit are as follows.

(a) During continuous drive: the fixing belt is not stopped or decelerated during printing and is continuously driven.

(b) During intermittent drive: the fixing belt is stopped in a position where the paper rear edge exits from the fixing nip and then advances by 15 mm (the position where no blisters occur) during printing, and reactivated when the leading edge of the next paper reaches the location 10 mm before the fixing nip.

(c) During low-speed drive: the fixing belt is decelerated to 10 mm/s in a position where the paper rear edge exits from the fixing nip and then advances by 15 mm (the position where no blisters occur) during printing, and the drive speed is restored when the leading edge of the next paper reaches the location 10 mm before the fixing nip.

The evaluation is performed by measuring average power consumption after the continuous printing has been maintained for five minutes in the above drive conditions.

Figure 12:
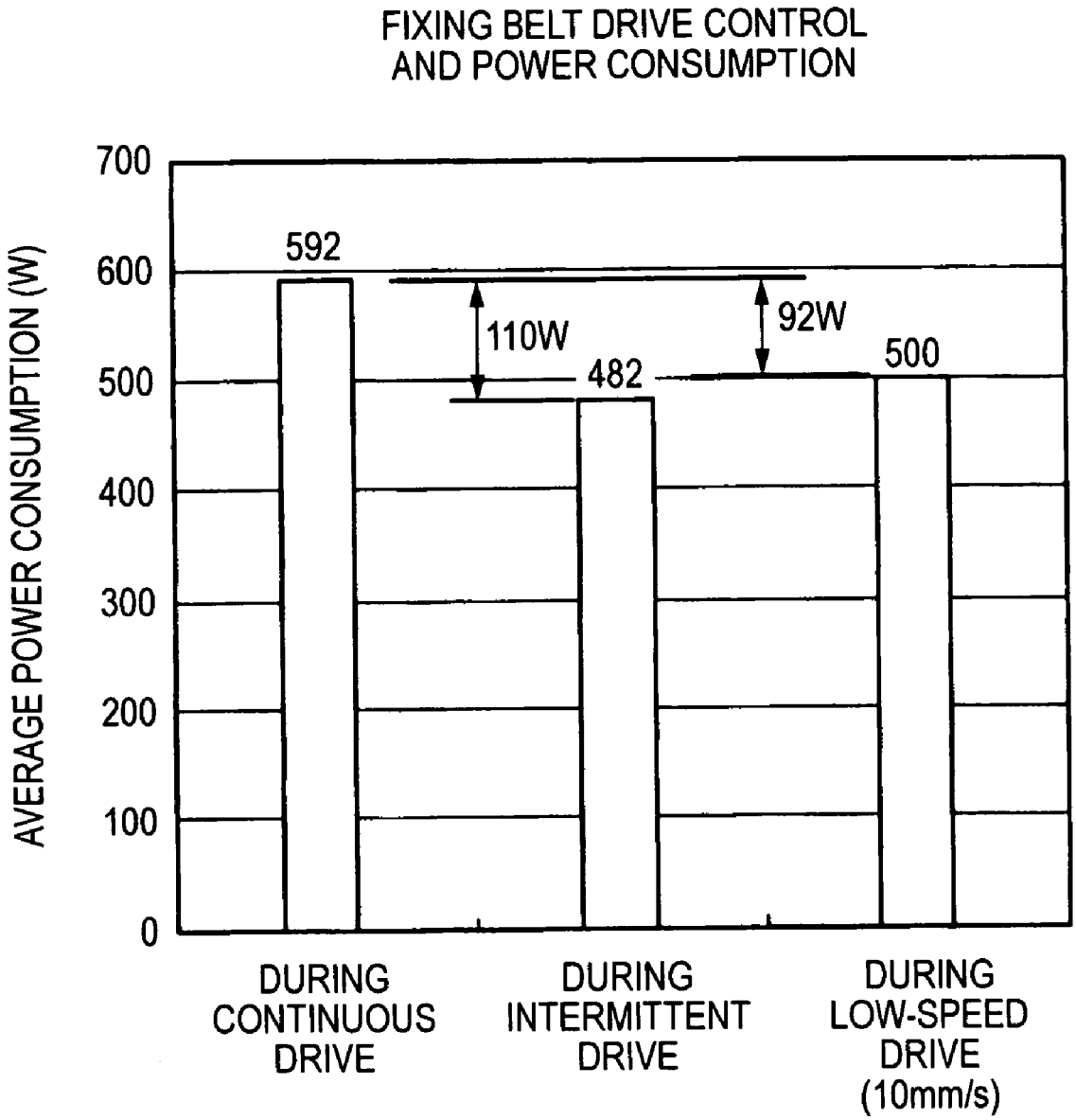
FIG. 12 is a graph showing the relationship between the drive control method of the fixing belt and the power consumption of example 1.

The result is as shown in FIG. 12. The average power consumption at the time of continuous drive is 592 W, the average power consumption at the time of intermittent drive is 482 W, and the average power consumption at the time of low-speed drive is 500 W. It is found that the power reduction of 110 W (reduction effect of about 19%) is performed by changing the continuous drive to the intermittent drive. Further, it is found that the power reduction of 92 W (reduction effect of about 16%) is performed by changing the continuous drive to the low-speed drive.

Figure 13A:
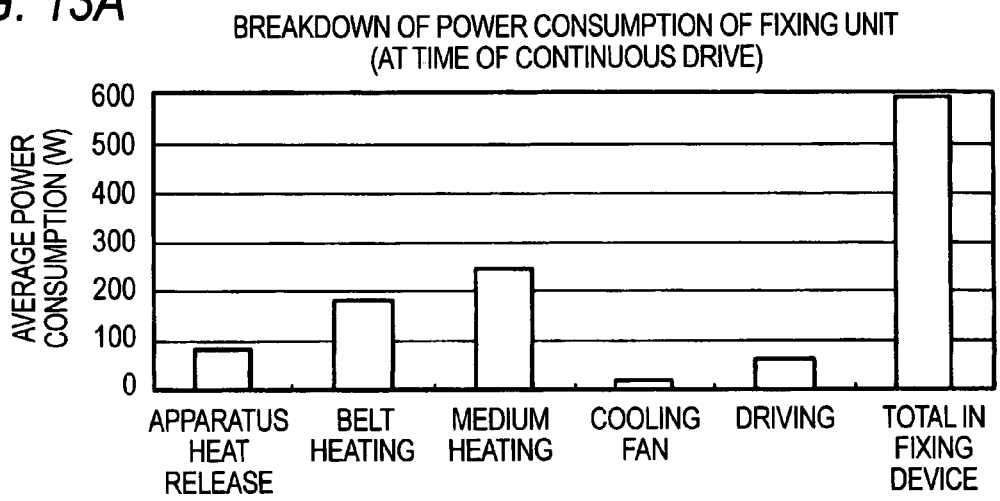
FIGS. 13A, 13B, and 13C are graphs showing detailed breakdowns of the power consumption of the fixing unit of example 1.
Figure 13B:
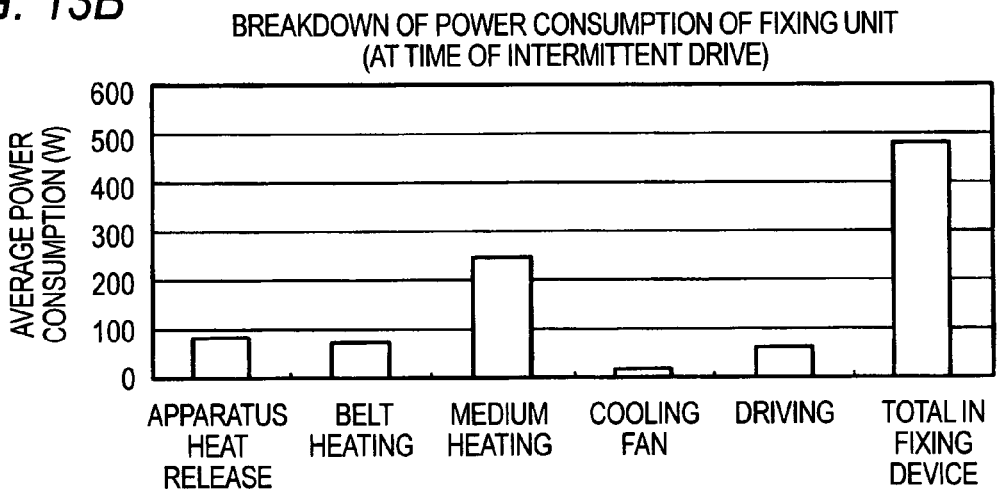
Figure 13C:
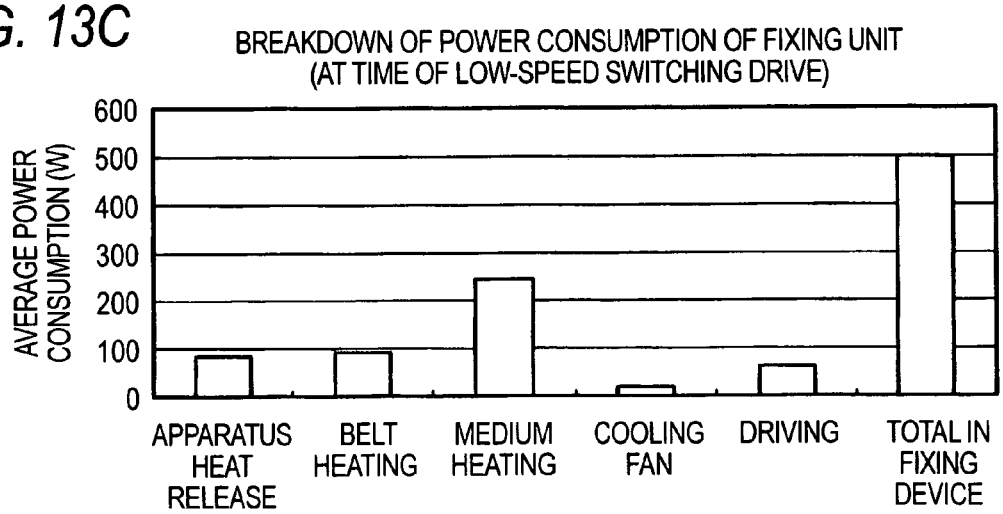

Further, FIGS. 13A, 13B, and 13C show detailed breakdowns of the power consumption. The power consumption is classified with respect to apparatus heat release (heat release part from the apparatus), belt heating (heating part to the fixing belt), media heating (heating part to the paper and toner), cooling fan (air blasting part to the cooler), and driving (power part required for driving) of the fixing unit. From the result, it is understood that the power difference in heating of the fixing belt appears in the power consumption difference.

When the fixing belt is stopped at timing with no paper in the fixing nip as with the intermittent drive in the example, sometimes the fixing belt thermally deforms into a shape that wraps around the fixing roll depending on the material of the fixing belt and the temperature of the fixing roll. In this case, the power reduction can be realized without causing thermal deformation of the fixing belt by not stopping the fixing belt but decelerating the driving speed.

EXAMPLE 2

The example is that, when A4-size printing with four sheets of L-size (89×127 mm) paper is continuously performed by the image forming apparatus of Embodiment 2, an evaluation test is performed on occurrence of blisters of paper on the fixing belt and image defects at the time of detachment.

The test conditions are as follows.

(1) Condition of Fixing Unit Settings

Fixing roll . . . width: 340 mm (effective width), outer diameter: 65 mm, elastic layer: none, surface preset temperature: 170° C.

Pressure roll . . . width: 340 mm (effective width), outer diameter: 65 mm, elastic layer: silicone rubber of 1 mm in thickness and 60 degrees in hardness, surface preset temperature: 140° C.

Fixing belt . . . width: 330 mm, perimeter: 550 mm, material: silicone rubber (50 degrees in hardness) of 40 μm is laminated on a thermosetting polyimide base material of 100 μm Fixing load . . . 2700 N Fixing belt drive speed at the time of fixing . . . 60 mm/s Cooler . . . heat sink length: 80 mm (in the transport direction)

(2) Paper

Size . . . A4 (four sheets of L-size paper are attached to 210×297 mm paper and then finished by cutting four sides of the respective images)

Thickness . . . 220 μm (basis weight: 225 gsm)

Surface finishing . . . polyester resin of 10 μm (viscosity is $10^4$ Pa·s at melting temperature of about 110° C.)

(3) Other Conditions

Paper transport direction . . . landscape orientation

Printing speed . . . two sheets per minute (corresponding to eight sheets per minute for L-size)

Toner . . . toner primarily consisting of styrene-acrylic resin having melting temperature of about 110° C. (viscosity is $10^4$ Pa·s)

As the blister evaluation, the same evaluation as that in Example 1 is performed. As shown in FIG. 14, the occurrence of blisters is not recognized when the edge departs from the fixing nip by 20 mm. Further, blisters occur for 15 mm, a distance which the occurrence of blisters is not recognized in Example 1. It is conceivable that more time is required for cooling paper because the temperature of the fixing roll etc. is set higher than that in Example 1. Therefore, from the example, it is confirmed that the fixing belt may be stopped or decelerated in a position where the rear edge of paper departs from the fixing nip by 20 mm.

On the other hand, regarding image defects, after temperature and glossiness irregularities at the time of detachment from the fixing belt are checked, the result as in FIG. 15 is obtained. From the result, it is found that no glossiness irregularities are recognized when the detachment temperature is equal to or less than 80° C.

Next, a comparison test with respect to average power consumption in the fixing unit when the drive control method of the fixing belt is changed is performed in the above described conditions.

The three kinds of drive conditions of the fixing unit are as follows as with the Example 1.

(a) During continuous drive: the fixing belt is not stopped or decelerated during printing and is continuously driven.

(b) During intermittent drive: the fixing belt is stopped in a position where the paper rear edge exits from the fixing nip and then advances by 20 mm (the position where no blisters occur) during printing, and reactivated when the leading edge of the next paper reaches the location 10 mm before the fixing nip.

(c) During low-speed drive: the fixing belt is decelerated to 10 mm/s in a position where the paper rear edge exits from the fixing nip and then advances by 20 mm (the position where no blisters occur) during printing, and the drive speed is restored when the leading edge of the next paper reaches the location 10 mm before the fixing nip.

The evaluation is performed by measuring average power consumption after the continuous printing has been maintained for five minutes in the above drive conditions.

Figure 16:
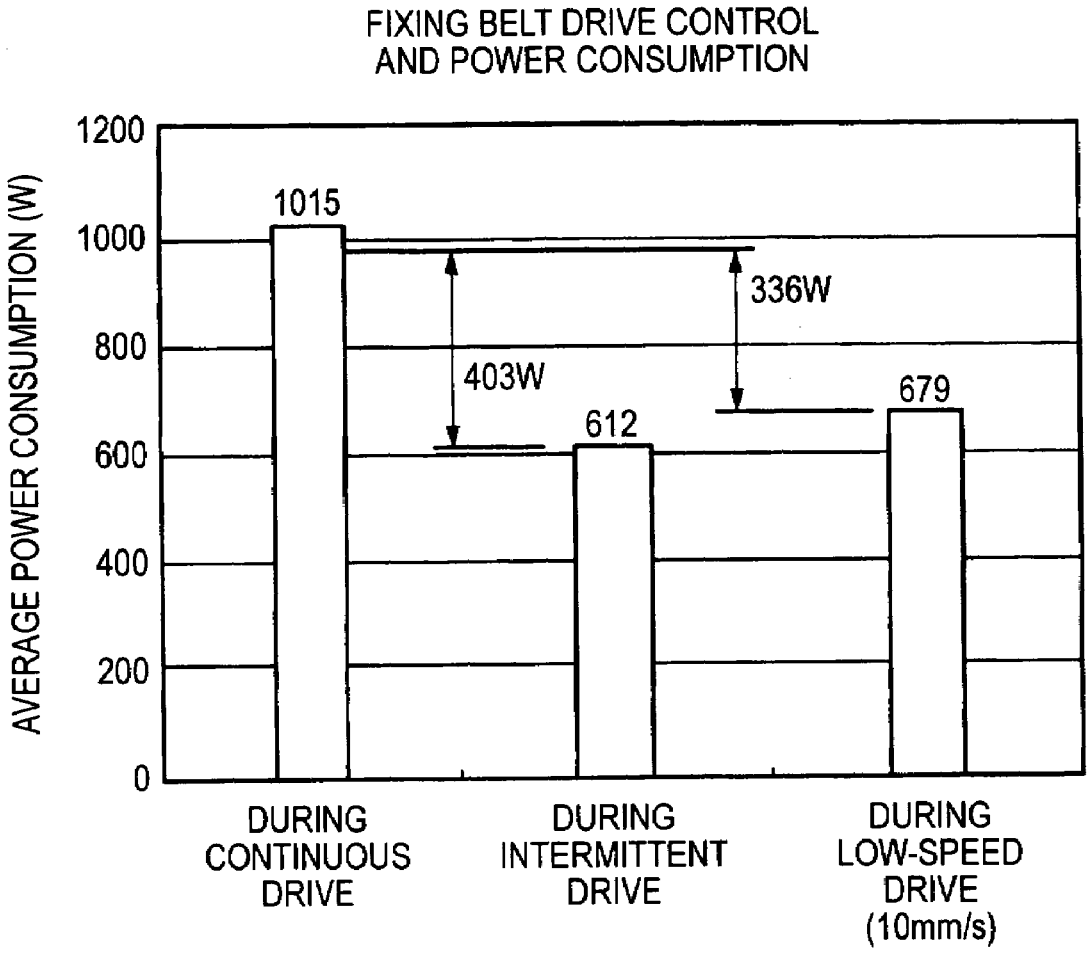
FIG. 16 is a graph showing the relationship between the drive control method of the fixing belt and the power consumption of example 2.

The result is as shown in FIG. 16. The average power consumption at the time of continuous drive is 1015 W, the average power consumption at the time of intermittent drive is 612 W, and the average power consumption at the time of low-speed drive is 679 W. It is found that the power reduction of 403 W (reduction effect of about 40%) is performed by changing the continuous drive to intermittent drive. Further, it is found that the power reduction of 336 W (reduction effect of about 33%) is performed by changing the continuous drive to low-speed drive.

Figure 17A:
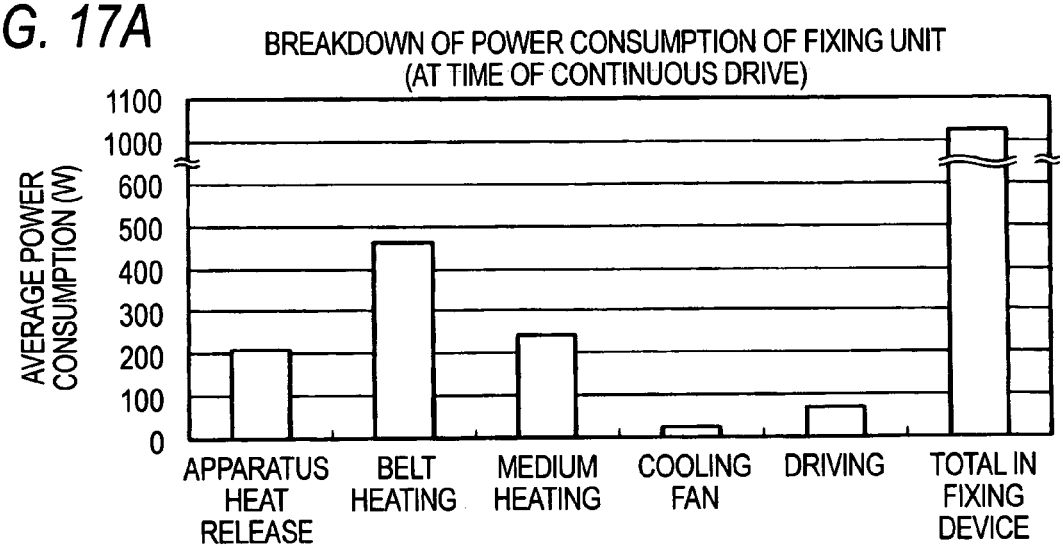
FIGS. 17A, 17B, and 17C are graphs showing detailed breakdowns of power consumption of the fixing unit of example 2.
Figure 17B:
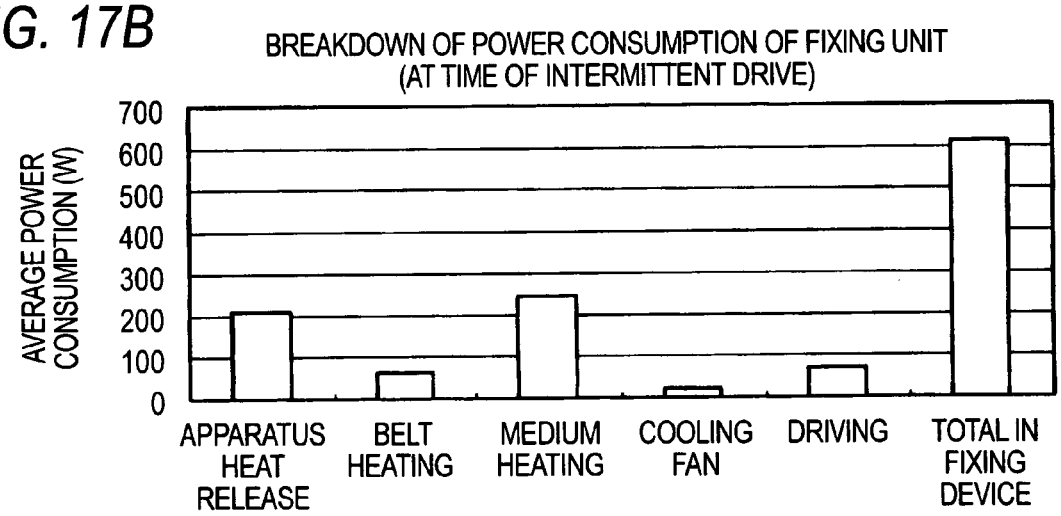
Figure 17C:
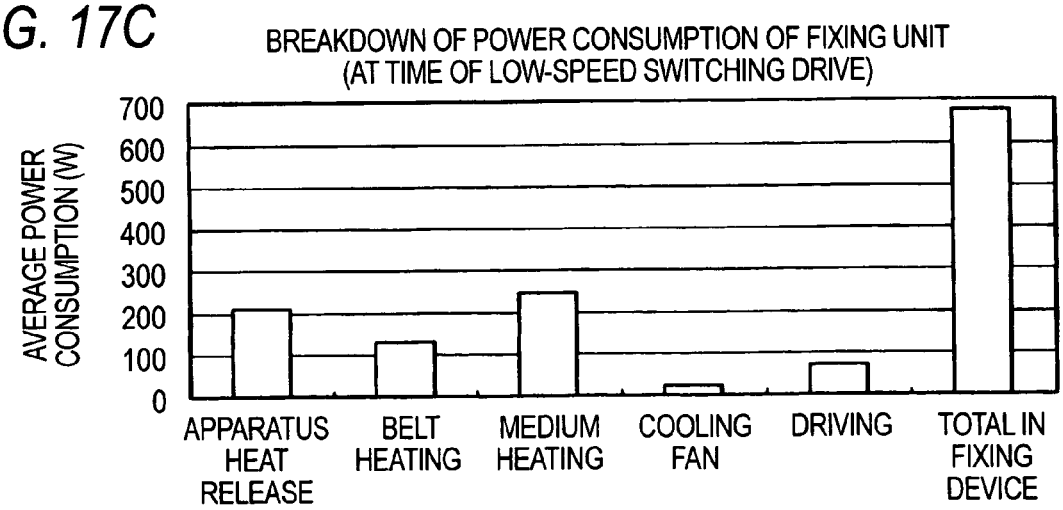

Further, FIGS. 17A, 17B, and 17C show detailed breakdowns of the power consumption as with example 1. The power consumption is classified with respect to apparatus heat release (heat release part from the apparatus), belt heating (heating part to the fixing belt), medium heating (heating part to the paper and toner), cooling fan (air blasting part to the cooler), and drive (power part required for driving) of the fixing unit. From the result, it is also understood that the power difference in heating of the fixing belt appears in the power consumption difference.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device for fixing an unfixed toner image by heating and pressurizing a recording material by which the unfixed toner image is carried, the fixing device comprising:

a heating member having a heat source;

a pressurizing member that faces the heating member and that forms a fixing nip region between the heating member and the pressuring member;

a belt member that circulates while being tensioned around the heating member and is able to transport the recording material while in contact with a surface of the unfixed toner image of the recording material; and a belt driving device that temporarily stops or decelerates the belt member after a rear edge of the recording material passes through the fixing nip region, and that restores the belt member before a leading edge of a subsequent recording material reaches the fixing nip region, wherein the belt driving device stops or decelerates the belt member when a temperature of at least one of the recording material and a part of the belt member being in contact with the recording material becomes less than or equal to a temperature at which no image defect is caused even when the toner image is detached from the belt member after fixing.

2. The fixing device according to claim 1, wherein the belt driving device stops or decelerates the belt member when the rear edge of the recording material is in contact with the belt member.

3. The fixing device according to claim 1, wherein the belt driving device stops or decelerates the belt member when a temperature of at least one of the recording material and a part of the belt member being in contact with the recording material becomes less than or equal to a temperature at which no blister is caused in the recording material after fixing.

4. The fixing device according to claim 1, wherein the temperature at which no image defect is caused is a temperature at which a toner viscosity is greater than or equal to about $10^5$ Pa·s.

5. The fixing device according to claim 1, wherein the belt driving device reduces power of the heat source in conjunction with stops or decelerations of the belt member.

6. The fixing device according to claim 1, further comprising a cooling device that contacts an inner surface of the belt member at a downstream side of the fixing nip and that cools the recording material after fixing.

7. The fixing device according to claim 6, wherein the belt driving device reduces power of the cooling device in conjunction with stops or decelerations of the belt member.

8. The fixing device according to claim 1, further comprising a thermoplastic resin layer on the toner image formation surface, wherein the belt driving device stops or decelerates the belt member when a temperature of at least one of the recording material and a part of the belt member being in contact with the recording material becomes less than or equal to a temperature at which smoothness of the thermoplastic resin layer surface is not deteriorated after fixing.

9. The fixing device according to claim 8, wherein the temperature at which smoothness of the thermoplastic resin layer is not deteriorated is a temperature at which a viscosity of the thermoplastic resin is greater than or equal to about $10^5$ Pa·s.

10. A fixing device for fixing an unfixed toner image by heating and pressurizing a recording material by which the unfixed toner image is carried, the fixing device comprising:

a heating member having a heat source;

a pressurizing member that faces the heating member and that forms a fixing nip region between the heating member and the pressuring member;

a belt member that circulates while being tensioned around the heating member and is able to transport the recording material while in contact with a surface of the unfixed toner image of the recording material; and a belt driving device that temporarily stops or decelerates the belt member after a rear edge of the recording material passes through the fixing nip region, and that restores the belt member before a leading edge of a subsequent recording material reaches the fixing nip region, wherein the belt driving device stops or decelerates the belt member when the rear edge of the recording material is in contact with the belt member.

11. An image forming apparatus comprising:

an image creating engine that forms an unfixed toner image on a recording material; and a post-processing device including:

a fixing device for fixing the unfixed toner image by heating and pressurizing the recording material by which the unfixed toner image is carried, the fixing device comprising:

a heating member having a heat source;

a pressurizing member that faces the heating member and that forms a fixing nip region between the heating member and the pressuring member;

a belt member that circulates while being tensioned around the heating member and is able to transport the recording material while in contact with a surface of the unfixed toner image of the recording material; and a belt driving device that temporarily stops or decelerates the belt member after a rear edge of the recording material passes through the fixing nip region, and that restores the belt member before a leading edge of a subsequent recording material reaches the fixing nip region, wherein the belt driving device stops or decelerates the belt member when a temperature of at least one of the recording material and a part of the belt member being in contact with the recording material becomes less than or equal to a temperature at which no image defect is caused even when the toner image is detached from the belt member after fixing.

12. The image forming apparatus according to claim 11, wherein the post-processing device includes a sheet cutting device, provided downstream of the fixing device, that cuts the recording material after fixing.

13. The image forming apparatus according to claim 12, wherein the sheet cutting device cuts at least a rear end portion of the recording material, and the belt driving device stops or decelerates the belt member at a temperature less than or equal to a temperature at which no blister is caused in a recording material that remains after cutting.

14. The image forming apparatus according to claim 11, further comprising a sensor that senses a leading edge or a rear edge of the recording material in a recording material transport path, wherein the belt driving device stops or decelerates the belt member based on a signal from the sensor.

15. The image forming apparatus according to claim 11, wherein the post-processing device is an optional device.

16. A fixing device for fixing an unfixed toner image by heating and pressurizing a recording material by which the unfixed toner image is carried, the fixing device comprising:

a heating means for heating the unfixed toner image;

a pressurizing means provided facing the heating means for forming a fixing nip region between the heating means and the pressuring means;

a transporting means being tensioned around the heating means and circulated for transporting the recording material while in contact with a surface of the unfixed toner image of the recording material; and a driving means for temporarily stopping or decelerating the transporting means after a rear edge of the recording material passes through the fixing nip region, and that restores the transporting means before a leading edge of a subsequent recording material reaches the fixing nip region, wherein the belt driving device stops or decelerates the belt member when a temperature of at least one of the recording material and a part of the belt member being in contact with the recording material becomes less than or equal to a temperature at which no image defect is caused even when the toner image is detached from the belt member after fixing.

* * * * *